United States Patent [19]

Schmidt et al.

[11] 4,202,640

[45] * May 13, 1980

[54] KEYBOARD ASSEMBLY

[75] Inventors: Helmut Schmidt, Villingen-Schwenningen; Walter Strobel, Unterkirnach; Günter Treude; Paul Blaser, both of Villingen-Schwenningen, all of Fed. Rep. of Germany

[73] Assignee: Kienzle Apparate GmbH, Villingen, Fed. Rep. of Germany

[ * ] Notice: The portion of the term of this patent subsequent to Nov. 7, 1995, has been disclaimed.

[21] Appl. No.: 900,771

[22] Filed: Apr. 27, 1978

Related U.S. Application Data

[63] Continuation of Ser. No. 779,936, Mar. 21, 1977, Pat. No. 4,124,313, said Ser. No. 779,936, is a continuation of Ser. No. 604,332, Aug. 13, 1975, abandoned, and a continuation of Ser. No. 604,333, Aug. 13, 1975, abandoned.

[30] Foreign Application Priority Data

Aug. 22, 1974 [DE] Fed. Rep. of Germany ..... 2440265

[51] Int. Cl.[2] ..... B41J 5/12

[52] U.S. Cl. ..... 400/491.2; 400/472; 200/5 R; 340/365 R; 84/DIG. 7; 248/27.3

[58] Field of Search ..... 400/472, 491, 491.2; 200/5 A, 5 R, 296, 294, 307, 340, 159 R, DIG. 1; 248/220.2, 223.1, 27.1, 27.3; 84/DIG. 7; 340/365 R; 235/145 R, 146

[56] References Cited

U.S. PATENT DOCUMENTS

| | | | |
|---|---|---|---|
| 3,259,699 | 7/1966 | De Rougemont | 200/5 R |
| 3,278,145 | 10/1966 | Leshuk | 248/27.3 |
| 3,486,077 | 12/1969 | Oeler et al. | 317/101 DH |
| 3,499,515 | 3/1970 | Mikrut | 197/98 |
| 3,533,045 | 10/1970 | Henschen | 317/101 DH |
| 3,544,739 | 12/1970 | Shah | 200/307 |
| 3,567,998 | 3/1971 | Ammerman | 317/101 DH |
| 3,594,562 | 7/1971 | Englund | 235/145 R |
| 3,626,131 | 12/1971 | Barney et al. | 200/294 |
| 3,626,133 | 12/1971 | Teruzzi | 200/159 R |
| 3,707,611 | 12/1971 | Twyford | 200/5 R |
| 3,708,635 | 1/1973 | Cosley et al. | 200/5 R |
| 3,749,859 | 7/1973 | Webb et al. | 200/5 R |
| 3,787,837 | 1/1974 | Allen et al. | 197/98 |
| 3,797,630 | 3/1974 | Zilkha | 197/98 |
| 3,845,254 | 10/1974 | Schneider | 317/112 |
| 3,863,040 | 1/1975 | Van Benschoten | 200/159 R |
| 3,899,648 | 8/1975 | Murata | 200/5 R |
| 3,900,712 | 8/1975 | Fukao | 200/307 |
| 3,903,458 | 9/1975 | Arnonk | 248/27.1 |
| 3,917,917 | 11/1975 | Murata | 200/5 A |
| 3,928,714 | 12/1975 | Comer | 200/340 |
| 3,964,593 | 6/1976 | Pointon | 197/98 |
| 4,124,313 | 11/1978 | Schmidt et al. | 400/491.2 |

FOREIGN PATENT DOCUMENTS

| | | | |
|---|---|---|---|
| 2152128 | 4/1973 | Fed. Rep. of Germany | 200/307 |
| 2304575 | 9/1973 | Fed. Rep. of Germany | 200/307 |

OTHER PUBLICATIONS

Cook et al., *Keyboard Mechanism*, IBM Technical Disclosure Bulletin, vol. 15, No. 2, p. 523, 7/72.

Jarvis, *Two Piece Actuator Button*, IBM Technical Disclosure Bulletin, vol. 13, No. 7, p. 1756, 12/70.

Barker et al., *Dummy Key Implementation*, IBM Tech. Discl. Bulletin, vol. 15, No. 6, p. 1930, 11/72.

Runyon, *Focus on Keyboards*, Electronics Design 23, p. 55, 11/72.

Duranske, "Keyboard Assembly," IBM Technical Disclosure Bulletin, vol. 20, No. 9, p. 3614, 2/78.

*Primary Examiner*—William Pieprz

*Attorney, Agent, or Firm*—Michael J. Striker

[57] ABSTRACT

A keyboard assembly includes a U-shaped carrier member and a plurality of key members connected thereon by resiliently yieldable legs having detent portions which engage cooperating recesses provided in the bottom wall of the U-shaped carrier member with snap action. Each key member has an upper and a lower housing port which are snap-fastened to each other, and an actuating shaft axially movable to energize an electrical component mounted below the carrier member. A locking member is also provided to lock the shaft in a down actuating position.

1 Claim, 3 Drawing Figures

7
6
6b
6a
6f
6e
6c
6d
11

2a
2d
2
1
2e
2b
2c
4
3

5d
5
5a
5c
5b
5f
8b
8a
8
8c
8d

KEYBOARD ASSEMBLY

CROSS REFERENCE TO RELATED APPLICATIONS

The present application is a continuation of prior copending application Ser. No. 779,936, filed Mar. 21, 1977 now U.S. Pat. No. 4,124,313 Application 779,936, in turn, was a continuation of two prior copending applications, Ser. Nos. 604,332 and 604,333, both filed Aug. 13, 1975 and both now abandoned.

BACKGROUND OF THE INVENTION

The present invention relates to a keyboard assembly, and more particularly to a novel construction of the individual keys which constitute the keyboard and a novel mounting arrangement of the keys with respect to electrical components to be energized.

As used throughout the specification and the claims, the term keyboard is intended to include a grouping of key members or switches and the like on a panel which, when the key members are depressed or actuated, will cause another element such as a shaft to move which, in turn, actuates another device such as a mechanical or electrical component.

Many different groupings or arrays are made possible by utilizing individual key members and by positioning them in any desired configuration. For example so-called ten button key sets, alphanumeric displays, computer input terminals, typewriters, teletype machines, and telephone dials are only a few examples of typical keyboard constructions having different numbers and orientations of the individual keys. The mosaic-like feature of mounting and demounting independent separate keys and especially small-sized keys, to form a large array makes for a particularly economical and simple arrangement. In addition, repairs and/or interchangeability of the individual key members are greatly simplified.

One disadvantage of all prior art arrangements using push-type or locking-type keys, which is common to both electrical contact-type keys and so-called electrical contactless-type keys, is that the electrical switching operation occurs within the key member itself. Not only is solder necessary to make the electrical connection and other fastening means needed to secure the key members to a carrier, but also additional fasteners are needed to connect each key member with the electronic circuitry to be actuated.

A further disadvantage common to all of the aforementioned type key members is that such keys are generally only insertable and removable from a key-carrying member from beneath the latter. This limited accessibility is particularly disadvantageous when one desires to repair and/or interchange one of the individual keys with another.

One known prior-art arrangement utilizes clamping devices to securely fasten the keys and their carrying member to a printed circuit board support member. This arrangement also teaches using locking screws. Both the clamping device and the locking screws require, for their installation, relatively lengthy amounts of time, thus making repairs and/or interchange of components costly. Moreover, this arrangement is further disadvantageous since it teaches the use of solder connections with the electrical devices mounted on a circuit board. As noted above, such electrical connections must be desoldered before demounting the key members.

Another prior art arrangement teaches the insertion of keys from above to a recessed plate by means of a pair of diametrically opposite, elastic locking projections. However, as noted above, this prior art arrangement teaches the disadvantage that the electrical connections at the bottom of the keys must be secured to a printed circuit board by means of solder. Hence, quick demounting of keys from the plate is not possible. First of all, the solder connection securely holds the key member to the electric circuit board, and secondly, the pair of locking projections can only be secured together if one gains access to the region beneath the plate. Thus, specially-designed openings are required to be machined into the printed circuit board, and specially-designed tools which must fit into these specially-designed openings are required in order to engage the pair of locking projecrions. The only way that the keys can then be removed from the carrier is if the electrical connections have first been desoldered.

Still another prior art arrangement inserts the individual keys from above into a support plate. Moreover, the input and output electrical cables are not directly led to the individual key members. Collars are provided on the support plate to allow the actuating shafts of the key members to pass therethrough and to securely fasten each key member in position. However, such keys are prone to turning about their axes so that, in order to prevent such turning, side projections are additionally required to be provided on the cap of the key members. These caps are received in specially designed openings in the support plate. The cap, the return spring and the actuating shaft of each key member is installed through the collars from above, and then the actuating parts which actuate the electrical devices are moved from the underside of the support plate onto the shaft and connected together by means of a screw.

In short, this prior art arrangement requires that the support plate be accessible on both its upper and lower sides. If many keys are to be mounted on a support plate, the circuit board must be spaced from the support plate by a predetermined distance. To accomplish this, the prior art uses screws and shims. This arrangement is particularly disadvantageous since an interchange of the individual key members or else the circuit board itself is very difficult to accomplish, especially in a short period of time.

Another prior art mounting arrangement inserts individual keys in a support plate. A portion of each key projects through the support plate to the underside thereof and is held in position by means of locking screws. This mounting arrangement is particularly undesirable, because demounting an individual key is very difficult since the entire keyboard must be removed in order to loosen the particular screw associated with the key to be repaired.

Another known prior art arrangement mounts the keys on a plate having pins which are electrically connected to electrical devices to be energized. The keys themselves are held in their correct positions by rods so that a demounting for interchanging an individual key for another from the keyboard is not possible.

SUMMARY OF THE INVENTION

Accordingly, it is a general object of the present invention to overcome the disadvantages of the prior art.

More particularly, it is an object of the present invention to provide a keyboard arrangement wherein the individual keys are snapped-in and snapped-out of a carrier member from above.

Another object of the present invention is to provide a keyboard arrangement wherein the individual keys can be interchanged without requiring a desoldering of electrical devices to be actuated by the individual keys.

A further object is to eliminate the use of clamps and locking screws to mount individual keys to a carrier member.

An additional object of the present invention is to eliminate the use of spring clips to mount individual keys to a carrier member.

Yet another object of the present invention is to eliminate the requirement for specially-designed openings and special tools to demount the keys from the carrier member.

Still a further object of the present invention is to provide a simple and economical keyboard arrangement.

Still another object of the present invention is to prevent the individual key members from turning about their respective axes.

Yet another object of the present invention is to space the carrier member a predetermined distance with respect to a printed circuit board support member so that the mounting and demounting features of the components of the invention is facilitated.

In keeping with these objects and others which will become apparent hereinafter, one feature of the invention is embodied in snap-action means for connecting at least one key member to a carrier member. One of the members has a plurality of recesses, and the other of the members has a plurality of elongated resiliently yieldable legs having detent portions which are adapted to engage the corresponding recesses with snap-action.

This feature overcomes all of the disadvantages mentioned above and achieves the aforementioned objects in a simple but novel manner. The keys are easily insertable and removable from above without the necessity of having to loosen locking screws or clamps. Moreover, no tools are required to squeeze the legs together, thus simplifying the demounting operation.

Since the legs of the keys hold the keys above a printed circuit board having electrical devices to be actuated, it is apparent that no electrical connections are made within the interior of the keys. Hence, no soldering or desoldering operations are required.

Another feature of the present invention is embodied in means for locking an actuating shaft of the key member in a down actuating position and for subsequently releasing the actuating shaft to assume an up non-working position. This feature is particularly advantageous when push-type keys are utilized.

Another feature of the invention is embodied in snap-action means for connecting a carrier member to a support member. One of the members has a plurality of recesses, and the other of the members has a plurality of resiliently yieldable elongated leg portions which are adapted to engage the recesses with snap action and to thereby maintain the carrier member a predetermined distance from the support member.

This feature of the invention overcomes the cited disadvantages and achieves the aforementioned objects in a simple but novel manner. The keyboard arrangement provides for a simple interchange of the carrier member with respect to the support member. By spacing the two members at a predetermined distance from each other, the members can be mounted and/or demounted from each other from above without requiring the use of additional work tools. Moreover, since there is no direct electrical connection between the printed circuit board and the carrier member that carries the key members, a quick and easy interchange between the printed circuit board support member and the carrier member is feasible without one having to first loosen clamping devices, screws, and/or desoldering electrical connections.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1*a* is an exploded perspective view of an apparatus according to the present invention;

FIG. 1*b* is a perspective view of the locking means of the apparatus of FIG. 1*a.

DESCRIPTION OF THE PREFERRED EMBODIMENT

Figures 1A, 1B:
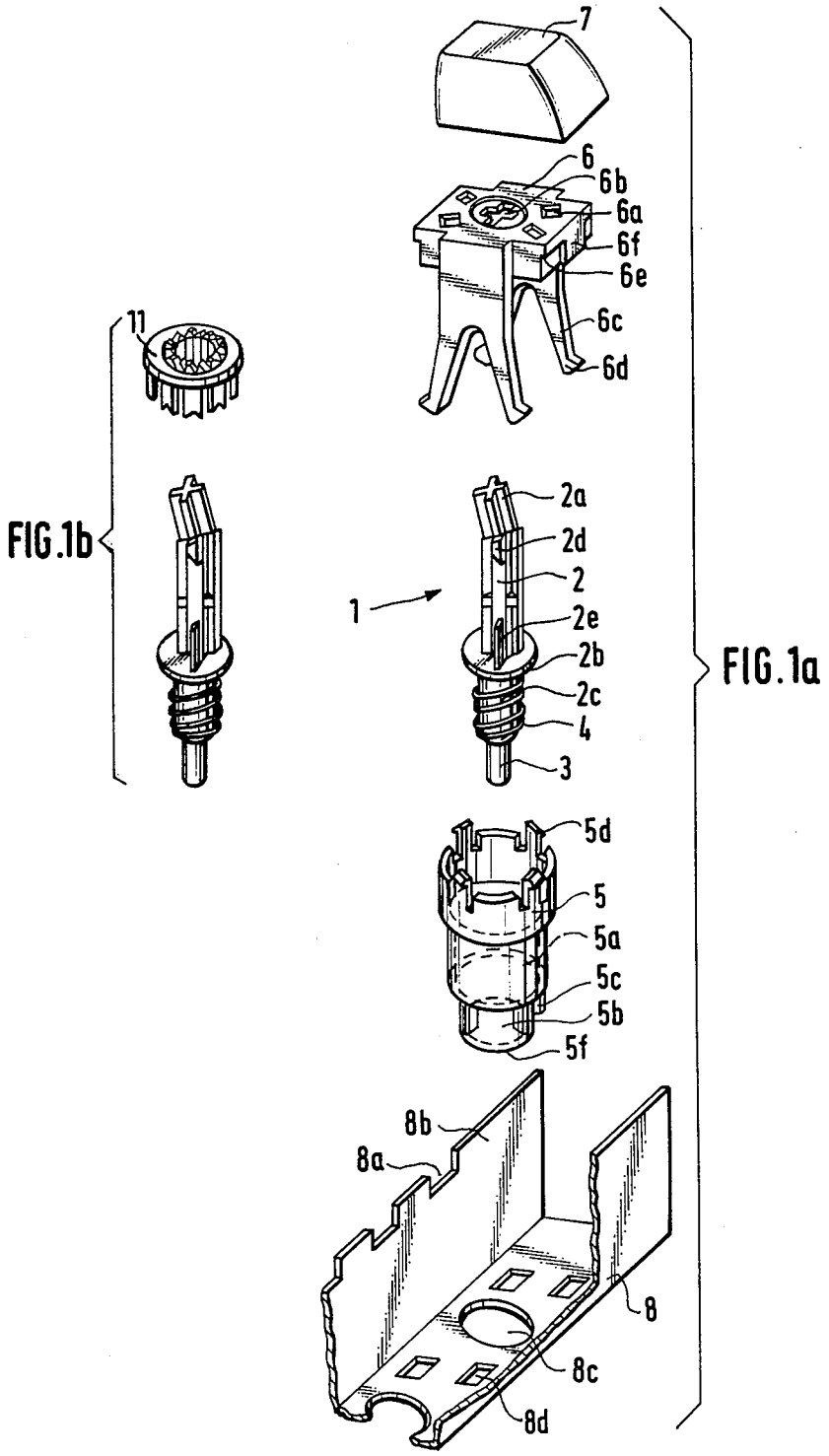

Referring to the exemplary embodiment illustrated in FIGS. 1*a,* 1*b* and 2, it will be seen that reference numeral 1 generally identifies one of a plurality of key members which is mounted on a carrier member 8. In turn, the sub-assembly of key members 1 and carrier member and/or carrier members 8 is mounted on support member 10.

As shown in an exploded view in FIG. 1*a,* the key member 1 is comprised of the following parts: An actuating shaft element 2, a lower housing part 5, an upper housing part 6 and a cap 7.

The actuating shaft element 2 has an upper part 2*a* which preferably is of cross-shaped cross-section, a lower part 2*c* which is preferably of cylindrical cross-section, and a flange part 2*b* of circular cross-section located intermediate the upper part 2*a* and the lower part 2*c*. A compression spring 4 surrounds lower part 2*c,* and one axial end of the spring 4 bears against the lower side of the flange 2*b*. An actuating pin 3 extends axially along the elongation of the shaft 2 and projects from the lower part 2*c*.

Axially-extending lugs 2*d* and 2*e* project laterally outwardly of a side of the shaft 2 and cooperate with locking element 11 (see FIG. 1*b*), as will be described in detail below.

The lower housing part 5 is generally of cylindrical configuration having an upper cylindrical section 5, a central cylindrical section 5*a,* and a lower cylindrical section 5*b*. All of the aforementioned sections are of constant diameter and, in the order listed, have successively smaller diameters. The lower housing part 5 receives the shaft 2 and the spring 4, and the lower cylindrical section 5*b* has an opening 5*f* which permits lower part 2*c* to pass therethrough. Axially-extending supporting projections or spacer elements 5*c* are distributed circumferentially about the outer circumferential surface of lower cylindrical section 5*b* and terminate short of the opening 5*f* by a predetermined axial distance. On the upper cylindrical section 5, axially-extending resiliently yieldable detent portions 5*d* are provided. In their normal unstressed position, the elongated detent portions 5*d* are generally aligned to be parallel with the axis of the shaft 2.

The upper housing part 6 has a head which is preferably of generally rectangularly-parallelopiped configuration, and further has a plurality of resiliently yieldable legs 6*c* extending downwardly of the head and having detent portions 6*d*. The head of upper housing part 6 has a plurality of recesses 6*a* distributed thereon which are adapted to receive the detent portions 5*d* with snap-action, that is, as the detent portions 5*d* are initially inserted into recesses 6*a*, the detent portions 5*d* are urged away from their normal unstressed positions parallel to the axis of the shaft 2 and, thereupon, after clearing the recesses 6*a*, the detent portions 5*d* return to their original positions by their inherent elasticity and resilience.

The head further includes a cross-shaped recess 6*b* adapted to receive the cross-shaped upper part 2*a* of the shaft 2. The cap 7 whose exterior contour can be fashioned in any arbitrarily chosen form, is then pushed onto the upper part 2*a*, thus completing the assembly of the key 1.

At two of the opposite sides of the rectangular head of the upper housing part 6, the aforementioned resiliently yieldable legs 6*c* are located. The two remaining sides are shaped so as to be accommodated on the carrier member 8. Specifically, the two remaining sides have a raised T-shaped portion 6*f* and two undercut portions having shoulders 6*e* on opposite sides of the vertical stem of the T-shaped portion 6*f*.

The carrier member 8 is of generally U-shaped configuration and is elongated. The upright side walls 8*b* have cutouts 8*a* distributed along the elongation of the carrier member 8 in a predetermined pattern. The key members 1 are mounted on the carrier member 8 by placing the T-shaped portion 6*f* into a cutout 8*a* and by resting the shoulders 6*e* on the edge regions of the side walls adjacent the cutouts 8*a*.

The side walls 8*b* are spaced apart a distance corresponding to the distance between the undercut portions located on opposite sides of the key member 1, so that directly opposite cutouts 8*a* on the respective sidewalls will mate with the T-shaped portions of located on the opposite sides of the key member 1. It is preferably if the thickness of the side walls 8*b* is chosen to substantially correspond to the distance that the T-shaped portion 6*f* is raised with respect to the undercut portions. Thus, the side walls of two adjacent carrier members 8 can be situated as directly and as closely as possible to one another. It is further preferable if the material of the head of the upper housing part 6, and particularly the T-shaped portion 6*f* and the shoulders 6*e* are made of the same material and/or rigidity which the side walls 8*b* of the carrier member 8 are constituted.

At the closed end of the carrier member 8, a plurality of recesses 8*d* are provided about a round aperture or hole 8*c*. The lower cylindrical section 5*b* is dimensioned to pass through the round hole 8*c* with clearance, and the supporting elements 5*c* contact the outer border region of the round hole 8*c* and support the lower housing part 5 from falling therethrough. The recesses 8*d* are shown to be rectangularly shaped, although they may be of other configuration. The resilient legs 6*c* and their detent portions 6*d* are inserted through the recesses 8*d*, and engage the latter by snap-action so as to fixedly secure a key member 1 to a carrier member 8.

The sub-assembly of key members 1 and carrier member 8 is mounted on a support member 10, which is preferably a printed electric circuit board, by means of a plurality of spacer elements 9. The spacer elements 9 are made of resiliently yieldable material and are located on and connected to the underside of the carrier member 8. Each of the spacer elements 9 have elongated leg portions which engage and snap into a plurality of recesses which are provided on the support member 10. The spacer elements 9 also maintain the carrier member 8 a predetermined distance from the support member 10. The placement of the recesses are chosen so that the key members 1, and more particularly the actuating pins 3, are correctly aligned with electronic circuitry provided on the support member 10, as will be described herein.

The printed circuit board or support member 10 is the only member which has input and output electrical wires or cables 12. In other words, no direct electrical cable or connection is wired or soldered to the key members 1.

The assembly and operation of the keyboard assembly are believed to be clear from the above-given description. The key member 1 is assembled by inserting the shaft 2 and the spring 4 into the lower housing part 5. Then, the upper housing part 6 is snapped into place over the detent portions 5*d*. The cap 7 is pushed onto the upper part 2*a* of the shaft 2 so that, when the cap 7 is pressed, the shaft 2 is urged downwardly against the compression force of the spring 4.

The actuating pin 3 is used to actuate the electronic circuitry on the support member 10 in at least two different ways. In a so-called "contact" type switch mode of operation, a first contact may be provided at the lower part 2*c* of the shaft 2 and a second opposing contact will be provided on the support member 10. Thus, by depressing the cap 7, the first and second contacts will be brought into direct contact with each other and energize an electrical device.

Figure 2:
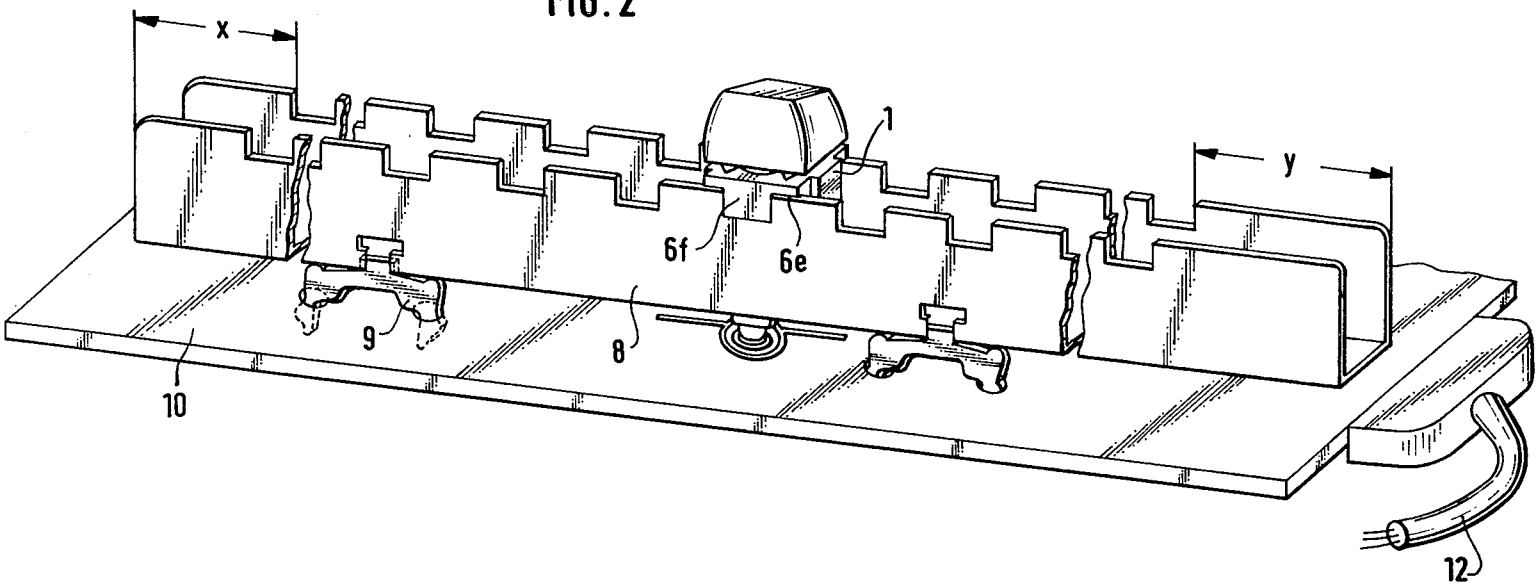
* and FIG. 2 is a perspective view of a portion of the keyboard arrangement according to the present invention.

In a so-called "contactless" type switch, the actuating pin 3 is made of electrically conductive material and is preferably a ferrite pin. Two winding coils are provided on the support member 10 which are adjacently positioned so as to be inductively coupled to each other. Between the two coils, a hole is provided, as shown in FIG. 2, to allow the ferrite pin 3 to pass through when the cap 7 is depressed. Thus, the actuation of the key member 1 causes the ferrite pin to increase the inductive coupling between the two coils which, in turn, is utilized to actuate other electrical devices.

In order to replace or interchange any component in the key member 1, the detent portions 5*d* can be bent without the aid of work tools. Thus, all of the elements of the key member 1 can be assembled and separated without the aid of tools.

It will be understood that additional carrier members 8 having additional key members 1 can be arranged on the illustrated support member 10 or on additional support members 10. No matter which arrangement is selected, no work tools are required to mount or demount any member with respect to any other member.

In order to demount and/or interchange the circuit board 10 from the carrier member 8, one need only manually press the resilient legs of the spacer elements 9 toward each other. Accessibility is guaranteed by the predetermined distance at which the carrier member 8 and the circuit board 10 is maintained with respect to each other. Another circuit board having recesses can then be inserted through the resilient legs and be snapped in place.

In summary, the keyboard arrangement can be completed by mounting the carrier member 8 unto the support member 10, then inserting the key members 1 onto the carrier member 8 and lastly by placing the cap 7 onto the key member 1. No direct electrical connections are made with the key members 1, and therefore none need be disconnected.

The resiliently yieldable portions mentioned in connection with the key members 1, the carrying members 8, or the spacer members 9 can be constituted of any resiliently yieldable material, and preferably of synthetic plastic material. The key member 1 described above is a push-type device. The term "push-type" device is intended to include those devices which must be continuously held down to energize the associated electrical device; that is, if one lets go of the cap 7, the actuating pin 3 will return to its original position due to the return action of the spring 4. In order to make the key member a so-called "locking-type" device, that is, a device which does not require to be continuously held down, a locking ring 11 is used (see FIG. 1*b*).

The locking ring 11 has an annular toothed upper portion and a lower portion of projections annularly spaced about the ring 11. The ring 11 is placed over the shaft 2, and the lug 2*d* is adapted to engage the toothed upper portion and the lug 2*e* is adapted to engage the lower portion. The construction and operation of the locking ring 11 and the lugs 2*d*, 2*e* is already known from the art of retractable ball point pens and is therefore not believed to require any extended discussion. It suffices to state that, upon a first actuation of the cap 7, the lug 2*d* rotates the ring 11 to a position so that the lug 2*e* engages a notch in one of the lower projections. The lug 2*e* thus keeps the actuating pin 3 in the down position. Upon a second actuation of the cap 7, the lug 2*d* rotates the ring 11 to another position so that the lug 2*e* is now placed in the space intermediate two of the lower projections. In this case, the actuating pin 3 returns to the up position. The use of a locking ring in connection with a key member 1 is believed to be yet another patentable feature of the invention.

A further advantageous feature is that the opposite end portions x, y of the elongated carrier member 8 are not provided with any cutouts; that is, the end portions x and y are shown free of any notches in FIG. 2. End portion y is relatively longer than end portion x.

In one application, if one arranged a plurality of elongated carrier members 8 adjacent each other so that all of the end portions x were on one side of the arrangement and all of the end portions y were on the other side of the arrangement, a matrix-type keyboard array would be realized. This is, the resulting rectangular array would have one key directly to the right, left, top and bottom of another key. This particular array is especially useful in so-called ten-button key sets.

If, on the other hand, the end portion y of one carrier member 8 were placed adjacent the end portion x of another carrier member, i.e., by turning one carrier in the previous example by 180°, then an offset array would be realized. Such an array is commonly used on typewriter keyboards, computer consoles, and alphanumerical keyboards.

The cutouts 8*a* on the elongated carrier member 8 may be spaced so that the sides of individual key members 1 directly contact each other or leave spaces intermediate these sides. Even if the sides do contact each other, one feature of the invention is that any individual key member is still accessible to be mounted and/or demounted from above after removing the cap 7 and lifting the housing parts 5 and 6 from the carrier member 8 by squeezing legs 6*c* together.

The invention may be modified from the exemplary embodiment given above without departing in any way from the spirit of the invention. The carrier member need not be U-shaped, but can have any arbitrary configuration so long as the key members 1 are insertable from above and can be securely snapped into position. The key member 1 can also have any arbitrarily chosen configuration, so long as each key member has a two-part housing having cooperating snap-type portions, and an actuating member movable to energize an electrical device.

Thus, the construction as disclosed is simple and economical to use.

It will be understood that each of the elements described above, or two or more together, may also find a useful application in other types of constructions differing from the types described above.

While the invention has been illustrated and described as embodied in a keyboard assembly, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitutes essential characteristics of the generic or specific aspects of this invention.

What is claimed as new and desired to be protected by Letters Patent is set forth in the appended claims.

1. A quick-assembly keyboard, for typewriters, calculators, data-processor input terminals, and the like, comprising, in combination, a plurality of assembled self-contained key units, each assembled self-contained key unit comprising a plurality of components including a stationary housing, a shaft movable relative to said housing, a cap connected to said shaft and operative for moving said shaft from an initial position to an actuating position, and biasing means for restoring said shaft to said initial position;

a plurality of elongated carrier members, each provided with a row of apertures extending along the length of said carrier member, said assembled self-contained key units and said carrier members being provided with cooperating first releasable connecting means mounting the assembled self-contained key units on said carrier members with said shafts of said assembled self-contained key units lined up with respective ones of said rows of apertures of said elongated carrier members, said first releasable connecting means mounting said assembled self-contained key units on said carrier members dismountably for dismounting of said key units from said carrier members from above said carrier members;

a circuit board provided with a plurality of electrical components, said carrier members and circuit board being provided with cooperating second releasable connecting means dismountably mounting said carrier members upon said circuit board at a predetermined spacing from the latter independently of said first releasable connecting means and with said shafts of said key units lined up with predetermined ones of said electrical components, each of said assembled self-contained key units including means holding said stationary housing, said shaft and said biasing means together in assembled condition independently of said first and second releasable connecting means, whereby dismounting of individual assembled self-contained key units from carrier members neither results in nor requires disassembly of the constituent components of the dismounted key units, said carrier members being dismountable from said circuit board without dismounting of said assembled self-contained key units from said carrier members and without disassembly of the caps, stationary housings, shafts and biasing means of the key units of thusly dismounted carrier members, by releasing said second releasable connecting means, each assembled self-contained key unit being dismountable from the carrier member on which it is mounted from above without disassembly of said stationary housing, shaft and biasing means of such key unit, by releasing said first releasable connecting means, the key units including no components permanently electrically connected to any components on the circuit board, whereby to provide no hindrance to dismounting of carrier members from the circuit board nor to dismounting of individual assembled self-contained key units from carrier members, the carrier members being mounted on the circuit board parallel to and adjoining each other so as to form a plurality of parallel and adjoining rows of key-unit caps.

* * * * *